United States Patent [19]

Yu

[11] Patent Number: 4,987,950

[45] Date of Patent: Jan. 29, 1991

[54] METHOD AND APPARATUS FOR CONTROLLING THE HEAT TRANSFER OF LIQUID COOLANT IN CONTINUOUS CASTING

[75] Inventor: Ho Yu, Murrysville, Pa.

[73] Assignee: Aluminum Company of America, Pittsburgh, Pa.

[21] Appl. No.: 366,759

[22] Filed: Jun. 14, 1989

[51] Int. Cl.[5] ..... B22D 11/22

[52] U.S. Cl. ..... 164/455; 164/451; 164/150; 164/414; 374/19; 137/88; 137/93

[58] Field of Search ..... 164/451, 452, 455, 486, 164/487, 150, 154, 414, 443, 444; 374/16, 19, 26, 27; 165/13; 356/128; 137/3, 88, 93, 828; 73/19

[56] References Cited

U.S. PATENT DOCUMENTS

| | | | |
|---|---|---|---|
| 3,136,325 | 6/1964 | Mattix | 137/3 |
| 3,441,079 | 4/1969 | Bryson . | |
| 3,479,859 | 11/1969 | Hager | 374/19 |
| 3,646,352 | 2/1972 | Bol et al. | 250/218 |
| 3,680,962 | 8/1972 | Hayakawa | 356/103 |
| 3,886,991 | 6/1975 | Meier et al. . | |
| 3,933,192 | 1/1976 | Rodenchuk et al. . | |
| 3,946,792 | 3/1976 | Thalmann | 164/455 |
| 3,974,681 | 8/1976 | Namery | 73/19 |
| 3,974,683 | 8/1976 | Martin | 73/19 |
| 4,138,879 | 2/1979 | Liebermann | 73/19 |
| 4,166,495 | 9/1979 | Yu . | |
| 4,344,429 | 8/1982 | Gupton et al. | 128/214 |
| 4,424,855 | 1/1984 | Tsubakihara et al. | 164/455 |
| 4,540,283 | 9/1985 | Bachalo | 356/336 |
| 4,627,726 | 12/1986 | Turner | 356/336 |
| 4,658,882 | 4/1987 | Oba et al. | 164/414 |
| 4,659,218 | 4/1987 | de Lasa et al. | 356/133 |
| 4,660,619 | 4/1987 | Nettlebeck et al. | 164/455 |
| 4,662,749 | 5/1987 | Hatton et al. | 356/336 |
| 4,693,298 | 9/1987 | Wagstaff | 164/486 |
| 4,779,762 | 10/1988 | Klein et al. | 137/88 |

OTHER PUBLICATIONS

"Plant Implementation of the Airslip Sheet Ingot Process", Greene et al., Light Metals, 1989, pp. 859–865.

*Primary Examiner*—Richard K. Seidel

*Attorney, Agent, or Firm*—David W. Pearce-Smith

[57] ABSTRACT

A method for continuously monitoring and/or controlling the cooling capacity of a liquid coolant containing gas bubbles. The method comprising the steps of: (a) measuring the size and number density of the gas bubbles it he liquid coolant by use of a sensor means to infer a heat transfer characteristic of the liquid coolant; and (b) varying the amount of gas that is being mixed with the liquid coolant so that the inferred heat transfer characteristic is within a predetermined range.

71 Claims, 4 Drawing Sheets

METHOD AND APPARATUS FOR CONTROLLING THE HEAT TRANSFER OF LIQUID COOLANT IN CONTINUOUS CASTING

FIELD OF THE INVENTION

The present invention relates to methods and apparatus for controlling the heat transfer characteristics of a liquid coolant containing gas bubbles. More particularly, the method and apparatus of the present invention relate to monitoring and retarding the withdrawal of heat from the surface of a continuously cast ingot by means of a liquid coolant containing gas bubbles.

BACKGROUND ART

Traditionally, continuous casting of light metal ingot has followed the practice of introducing molten metal into one end of an open-ended mold and withdrawing a solid or partially solidified ingot from the opposite end. Typically, the casting mold is relatively short in the axial direction and is hollow or otherwise adapted to receive a liquid cooling medium, such as water, which chills and solidifies the ingot meniscus. The water is then discharged from the mold and continues to chill the ingot as it contacts the ingot surface. Molds are preferably constructed of aluminum but may also be copper, bronze or another material which exhibits high thermal conductivity.

U.S. Pat. No. 4,166,495 issued to Yu discloses an ingot casting method for controlling the withdrawal of heat from the surface of a cooling ingot. The essence of the invention of U.S. Pat. No. 4,166,495 is the mixing of a gas with the liquid coolant before the liquid coolant is applied to the ingot surface. When the gas containing liquid coolant is applied to the mold during the initial stages of casting, the gas mixed in the liquid coolant acts to retard the rate of heat extraction of the liquid coolant. When the amount of gas mixed with the liquid coolant is reduced, the rate of heat extraction by the mold is increased. The increased rate of heat extraction is used on subsequent portions of the emerging ingot length.

The method of U.S. Pat. No. 4,166,495 is a commercially successful method of retarding the cooling effect of the liquid coolant and has come to be known in the aluminum industry as the Alcoa 729 process. The Alcoa 729 process has been successfully used to cast ingot having a width to thickness ratio of 5.3.

This is the largest width to thickness ratio that the applicant knows is commercially feasible for casting ingot and is obtainable only by using the Alcoa 729 process. A preferred coolant of the Alcoa 729 process is water and one preferred gas is $CO_2$. Water is a preferred coolant because it is inexpensive and abundant. $CO_2$ is preferred because it is odorless, inexpensive, highly soluble in water and relatively harmless to the environment. In addition, since there is no gaseous buildup in the recycled water, $CO_2$ does not suffer from many of the disadvantages associated with chemical additives. Other gases which are substantially insoluble in water, such as for example air, may also be used in practicing the method of U.S. Pat. No. 4,166,495.

U.S. Pat. No. 4,693,298 issued to Wagstaff discloses a means and technique for casting metals at a controlled direct cooling rate. The method of U.S. Pat. No. 4,693,298 involves mixing liquid coolant and a gas which is substantially insoluble in the liquid coolant by discharging the gas through jets. The jets release the gas in the flowing liquid coolant as a mass of bubbles that tend to remain discrete and undissolved in the coolant as the coolant on the surface of the ingot.

Although the Alcoa 729 process is economical and effective, it is improvable. The amount of gas that must be mixed with the liquid coolant in the process is very sensitive to changes in temperature, mixing pressure, and water quality. The ability of the gas to retard the heat of extraction of the liquid coolant is determined by the volatility of the liquid, which depends on the concentration of gas mixed in the liquid coolant, the temperature of the liquid coolant, the velocity of coolant flow and the coolant quality of the liquid coolant. The term "quality" as used herein means the chemistry of the liquid coolant and it includes properties such as ph, alkalinity, dissolved and suspended solids, surface tension and ionic species. The sensitivity of the process to changes in temperature and coolant quality requires that the amount of gas that is added to the cooling medium must be constantly adjusted by trial and error so that the desired heat transfer characteristics of the liquid coolant can be maintained. The temperature sensitivity and coolant quality sensitivity of the Alcoa 729 process makes casting of some ingots extremely difficult.

Accordingly, it would be advantageous to provide an economical and effective method of monitoring and controlling the cooling effect of the liquid medium at a desirable level even though the coolant quality and temperature may vary.

The primary object of the present invention is to provide a method and apparatus for monitoring the cooling effect of the liquid medium containing gas bubbles.

Another object of the present invention is to provide a method and apparatus that can be readily added to existing casting facilities which permits a greater control of the rate of heat extraction from a liquid coolant in which gas has been mixed to regulate the cooling rate of the coolant when it is used to cool the surface of a continuously cast ingot.

A further object of the present invention is to provide a method and apparatus for continuously casting ingots that can compensate for changes in the heat transfer characteristics of the cooling medium due to changes in the temperature and coolant changes without dramatic variations in the flow rates of the liquid cooling medium.

Another object of the present invention is to provide a method and apparatus that can be readily added to existing casting facilities which permits a monitoring of the size and concentration of the gaseous bubbles in a liquid medium that is used to cool the surface of a continuously cast ingot.

Yet another object of the present invention is to provide a method and apparatus that can be readily added to existing casting facilities which permits the casting of ingot with a larger width to thickness ratios than has heretofore been commercially feasible.

Another object of the present invention is to provide a method and apparatus that can be readily added to existing commercial casting facilities which permits the casting of ingot with an aspect ratio greater than 5.3.

Still another object of the present invention is to provide a method and apparatus that can be readily added to existing casting facilities which reduces the severity of the most common deformities occurring on the butt end or the initially emerging bottom surface of a continuously cast ingot.

Still another object of the present invention is to provide a method and apparatus that can be readily added to existing casting facilities which will minimize ingot butt curl on the butt end or the initially emerging bottom surface of a continuously cast ingot.

Still a further object of the present invention is to provide a method and apparatus that can be readily added to existing casting facilities which will increase the safety of ingot startup by minimizing the possibility of an explosive bleed out in the butt end or the initially emerging bottom surface of a continuously cast ingot.

Still another object of the present invention is to provide a method and apparatus that can be readily added to existing casting facilities which will (a) monitor and control the transition from a liquid coolant containing gaseous $CO_2$ to a non-gaseous liquid coolant and (b) minimize the ingot deformation that is normally associated with the transition.

These and other objects and advantages of the present invention will be more fully understood and appreciated with reference to the following description.

DISCLOSURE OF THE INVENTION

A method for continuously monitoring the cooling capacity of a liquid coolant containing gas bubbles. The method comprising the steps of: (a) sensing the number density of bubbles within a predetermined size range and (b) comparing the number density to a predetermined number and if necessary varying the amount of gas that is being mixed with the liquid coolant so that the number density obtained is within said predetermined range.

A second aspect of the invention is an improved method for continuously casting metal ingots which includes the steps of: (a) casting molten metal into an open-ended mold; (b) providing a liquid coolant; (c) mixing a gas with the liquid coolant so that the liquid coolant contains gas bubbles; (d) measuring the size and number density of the bubbles of the gas in the liquid coolant by use of a sensor means to infer a heat transfer characteristic of the liquid coolant; (e) varying the amount of gas that is being mixed with the liquid coolant so that the inferred heat transfer characteristic is within a predetermined range; and (f) applying the liquid coolant to the casting operation.

Another aspect of the invention is a method for continuously monitoring the cooling capacity of a liquid coolant containing gas bubbles, said method comprising the steps of: (a) generating a signal which is related to the number density of the bubbles within the liquid coolant and (b) comparing the generated signal to a predetermined signal range and if necessary varying the amount of gas that is being mixed with the liquid coolant so that the generated signal is within the predetermined signal range.

Another aspect of the present invention is an apparatus for continuously monitoring the cooling capacity of a liquid coolant containing gas bubbles, the apparatus includes: (a) a measuring means for measuring the number density of the bubbles to infer the heat transfer characteristics of the liquid coolant; and (b) a control means for varying the amount of gas in the liquid coolant so that the number density is within a predetermined range.

Still another aspect of the present invention is an apparatus for casting a melt into an ingot: (a) a mold for holding a reservoir of melt; (b).an application means for applying liquid cooling medium to the mold to effectuate at least partial solidification of the molten metal therein, the liquid cooling medium containing a gas which forms bubbles which act to retard the rate of heat extraction from the ingot; (c) a sensing means for sensing the number density of bubbles within a predetermined size range and (d) a means for comparing the number density to a predetermined number and if necessary varying the amount of gas that is being mixed with the liquid coolant so that the number density obtained is within said predetermined range; and (e) a control means for varying the amount of gas mixed with the liquid cooling medium to bring the number density the liquid cooling medium within a predetermined range.

An additional aspect of the present invention is a method for continuously casting metal ingots having a higher width to thickness ratio than existing methods, the method comprises the steps of: (a) casting molten metal into an open-ended mold having a high width to thickness ratio; (b) applying liquid cooling medium to the mold to effectuate at least partial solidification of the molten metal therein, the liquid cooling medium containing a gas which forms bubbles in the liquid cooling medium, the bubbles act to retard the rate of heat extraction from said ingot; (c) monitoring the size and number density of the bubbles by use of a light source to infer heat transfer characteristics of the liquid cooling medium; (d) inferring a heat transfer characteristics of the liquid cooling medium from the size and number density of the bubbles; and (e) varying the amount of gas mixed with the liquid cooling medium to bring the inferred heat transfer characteristic of the liquid cooling medium within a predetermined range.

Another aspect of the present invention is a method for continuously casting metal ingots using a liquid coolant, the method comprising the steps of: (a) casting molten metal into an open-ended mold used to form an ingot which emerges therefrom; (b) providing a liquid coolant; (c) mixing a gas with the liquid coolant so that the liquid coolant contains gas bubbles; (d) passing light through the liquid coolant onto a light sensing device; (e) sensing the number density of micron size bubbles from the scattering of the light; (f) comparing the number density to a predetermined number and if necessary reducing the amount of said gas that is being mixed with the liquid if the number density exceeds said predetermined range and increasing the amount of the gas that is being mixed with the liquid if the number density falls below the predetermined range, the predetermined range varying from a first range that is used during the initial stages of casting when the ingot is in a startup state to a second range that is used when the emerging ingot is in a steady state; and (g) applying the liquid coolant to the ingot emerging from the mold to effectuate at least partial solidification of the molten metal.

BRIEF DESCRIPTION OF THE DRAWINGS

Other features of the present invention will be further described or rendered obvious in the following related description of the preferred embodiment which is to be considered together with the accompanying drawings, wherein like numbers refer to like parts and further wherein.

DESCRIPTION OF THE PREFERRED EMBODIMENTS

The term "continuous" as used herein refers to the progressive and uninterrupted formation of a cast metal ingot in a mold which is open at both ends. The pouring operation may continue indefinitely if the cast ingot is cut into sections of suitable length at a location away from the mold. Alternatively, the pouring operation may be started and stopped in the manufacture of each ingot. The latter process is commonly referred to as semicontinuous casting and is intended to be comprehended by the term "continuous".

Figure 1:
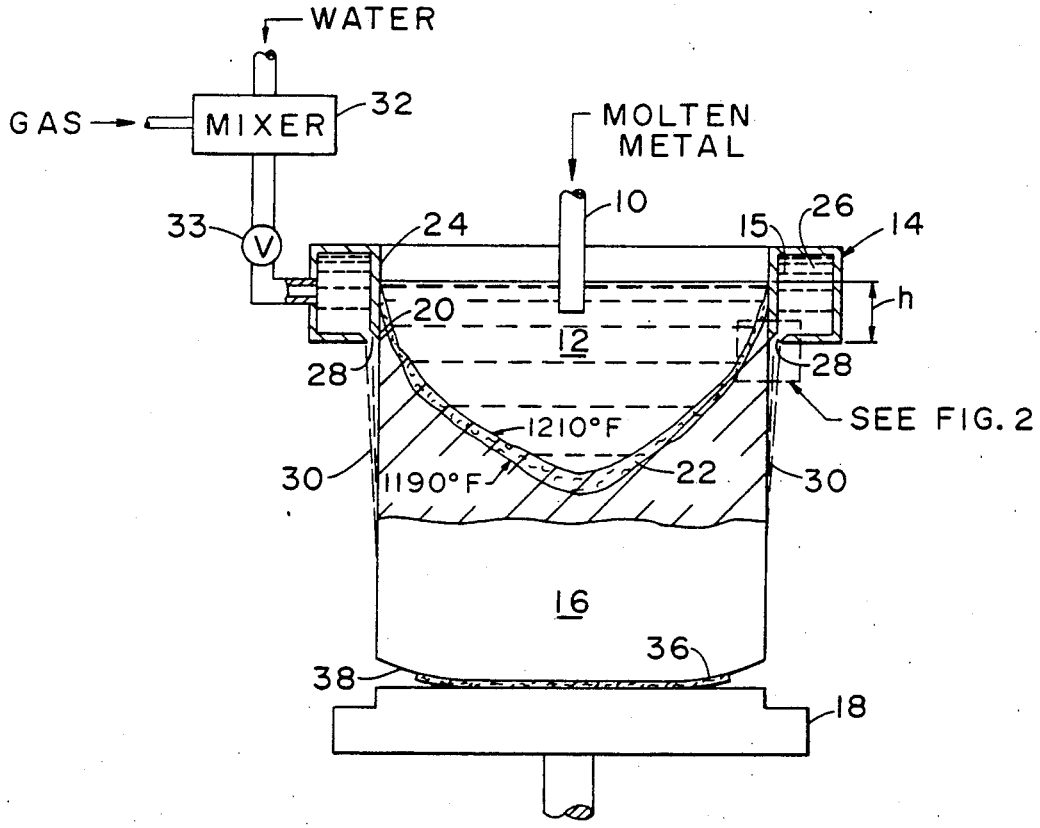
FIG. 1 (PRIOR ART)
FIG. 1 is a view in vertical section showing the apparatus used in practicing the prior art process in accordance with U.S. Patent No. 4,166,495.

Referring first to FIG. 1, there is illustrated a continuous casting apparatus used in practicing the prior art process disclosed in U.S. Pat. No. 4,166,495. The content of U.S Pat. No. 4,166,495 is included herein by reference. The prior art apparatus shown in FIG. 1 generally includes a pouring spout 10 for molten metal 12, a casting mold 14 generally defining the transverse dimensions of the ingot 16 being cast. The casting mold may be any type of casting mold which is known in the art, including a mold used for electromagnetic casting. The prior art apparatus of FIG. 1 also includes a vertically movable bottom block 18 which closes the lower end of the mold 14 at the beginning of the casting operation and by its descent determines the rate at which the ingot 16 is advanced from the mold 14.

In order to insure that the continuous casting operation is understood, a few definitions should be provided at the outset. Metal "head" is defined as distance from the free surface of the molten metal in the casting basin to the bottom of mold 14. Head is illustrated in FIG. 1 by dimension "h". "Crater" is the term used to define the molten metal pool which exhibits an inverted, generally wedge-shaped configuration from the meniscus of the molten metal level in mold 14 to a location some distance from the exit end of mold 14, which is centrally located in ingot 16. Although the cross-sectional crater profile is often illustrated as a solid line separating molten metal from solid metal, it will be understood by those skilled in the art that there is a mushy zone 22 where the metal is not fully solid yet not really liquid separating the molten and solid phases.

Returning again to FIG. 1, molten metal 12 may be transferred to the casting unit directly from a furnace or from a melting crucible. Molten metal 12 is poured through pouring spout 10 or the like into mold 14 having its bottom closed by bottom block 18. Flow control devices (not shown) may be provided to minimize cascading and turbulent metal flow and to insure even molten metal distribution.

Mold 14 is a conventional direct chill casting apparatus and may be internally cooled, usually with a liquid cooling medium such as water. Mold 14 is typically constructed of a material having high thermal conductivity, such as aluminum or copper, to insure that the coolant temperature is transferred as efficiently as possible through the inner mold wall 24 to the metal to effect solidification.

The coolant 15 used for direct cooling in the continuous casting unit illustrated in FIG. 1 is typically water. Other fluids may be used, however water is preferred because of its availability, cost and heat removal capacity. As long as the water temperature is less than about 90° F. (32° C.) and greater than about 32° F. (0° C.), cooling efficiency is not significantly affected. The water fills passageway 26 and is fed through the multiple orifices 28 which are spaced around mold 14 and extend through the lower inside corner 20 of the mold. Orifices 28 are constructed and spaced such that the cooling water fed therethrough is directed against the exterior surfaces of ingot 16 forming a uniform blanket of water 30 about the emerging portion of the ingot.

As stated above, a preferred gas which is used in the process described in U.S. Pat. No. 4,166,495, is carbon dioxide ($CO_2$). Carbon dioxide is soluble in water. The dissolved carbon dioxide concentration of water 15 is measured in terms of volumes. At atmospheric pressure and at a temperature of 60° F. (16° C.), a given volume of water will dissolve an equal volume of carbon dioxide and is said to contain one volume of dissolved carbon dioxide. Solubility of carbon dioxide in water increases with increases in pressure. As the pressure of the carbon dioxide is decreased, its solubility is decreased. However, the solubility of carbon dioxide in water also decreases as the temperature of the water increases. The dissolving of $CO_2$ may readily take place in an absorption or mixing device 32, such as a pump or a static mixer. The gas is dissolved into the ingot cooling water prior to the feeding of the water through valve 33 onto the exterior ingot surfaces. In a single supply water system, as illustrated in FIG. 1, it is practical to dissolve the gas in the water, before the water is fed to the mold. Preferably at least 50% of the gas mixed with the coolant is dissolved with the coolant.

Figure 2:
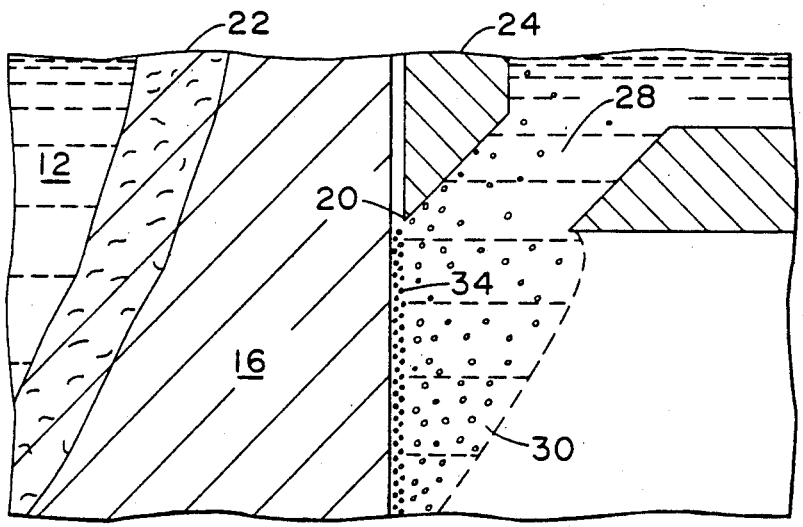
FIG. 2 is an enlarged cross-sectional view of portion II of FIG. 1.

As mentioned above, the dissolved gas comes out of solution when pressure drops. As illustrated in FIG. 2, which is an enlarged view of Section II of FIG. 1, a portion of the released gas adheres to the exterior surface of the emerging ingot 16 forming a uniform, yet effective, insulation layer 34 which acts to retard the heat extraction otherwise effectuated by the cooling medium. It has been found that the use of sufficient dissolved carbon dioxide in cooling water to provide a continuous gaseous blanket on the ingot surface results in the formation of an insulation layer which can significantly reduce the normal heat transfer rate. Therefore, in practicing the process disclosed in U.S. Pat. No. 4,166,495, the initial stages of the vertical continuous casting operation results in a reduction of ingot butt curl and butt swell. To achieve better reductions in ingot butt swell, an insulation pad 36, typically a ceramic fiber blanket or the like, may be utilized as a cover over, preferably, at least 50% to 60% of the bottom face 38 of ingot 16 to minimize heat loss through the bottom block 18.

It is understood by those skilled in the art that insulation layer 34, shown in the enlarged cross-sectional view of FIG. 2, is constantly renewing. The volume of water being fed onto the ingot surfaces is too great to expect the insulation layer to be unaffected by flow rate. Therefore, it is expected that insulation layer of gas 34 is constantly being eroded, yet substantially simultaneously it is being replaced by the released gas contained in the incoming water. The gas particles tend to follow the path of least resistance and, therefore, a larger portion of the gas particles are automatically washed out of the system. However, new gas particles tend to adhere to a surface; therefore, there is always a uniform layer 34 of gas particles on the ingot surface as long as the gas is being dissolved in the coolant.

Minimizing ingot butt deformities requires retarding the cooling effect of the direct chill coolant during the initial stages of the continuous casting operation. This can be accomplished, for example, by dissolving from 10 to 30 SCFM (0.0046 to 0.0142 cubic meters per second) of carbon dioxide into the cooling water depending on the cooling water flow rate. Usually, after the first two to four inches (50.8 to 101.6 mm) of an ingot have emerged from the mold, the insulating layer of gas 34 is no longer required. To remove the insulating layer 34, all that is required is to shut off the gas flow. Preferably, such shut-off is gradual so as to progressively increase the rate of heat extraction provided by the coolant and thereby eliminate extreme imbalance of the overall cooling process. A typical gas flow rate of 22 SCFM (0.0104 cubic meters per second) of carbon dioxide in about 250 gallons (946 liters) per minute of water is preferably reduced to a near zero gas feed rate over a period of about two minutes. Thus, after less than about 12 inches (254.0 mm) of ingot emergence, which constitutes the initial stage of casting, substantially no gas is being dissolved into the coolant.

As described in "A Process to Reduce Ingot Butt Curl and Swell", Ho Yu, Journal of Metals, Nov. 1980, the prior art apparatus of FIG. 1 retards ingot cooling by promoting film boiling of the carbonated cooling water when it comes into contact with the ingot surface. The total pressure of the boiling water containing dissolved carbon dioxide, which is greater than atmospheric pressure, is equal to the water-vapor pressure plus dissolved carbon dioxide partial pressure. The dissolved carbon dioxide, therefore, lowers the boiling point of the ingot cooling water and promotes film boiling of the water when it is released from the ingot water.

Despite all of the widely recognized benefits of the process disclosed in U.S. Pat. No. 4,166,495, there is room for improving the control of the process. Too little or too much gas in the liquid coolant is sub-optimal. The correct amount of gas that must be mixed with the liquid coolant is dependent on and very sensitive to changes in temperature, mixing pressure, and water quality.

According to the method of the prior art described above, it takes time and requires skill to adjust gas flow rates according to the gas concentration dissolved in the liquid coolant.

Figure 3:
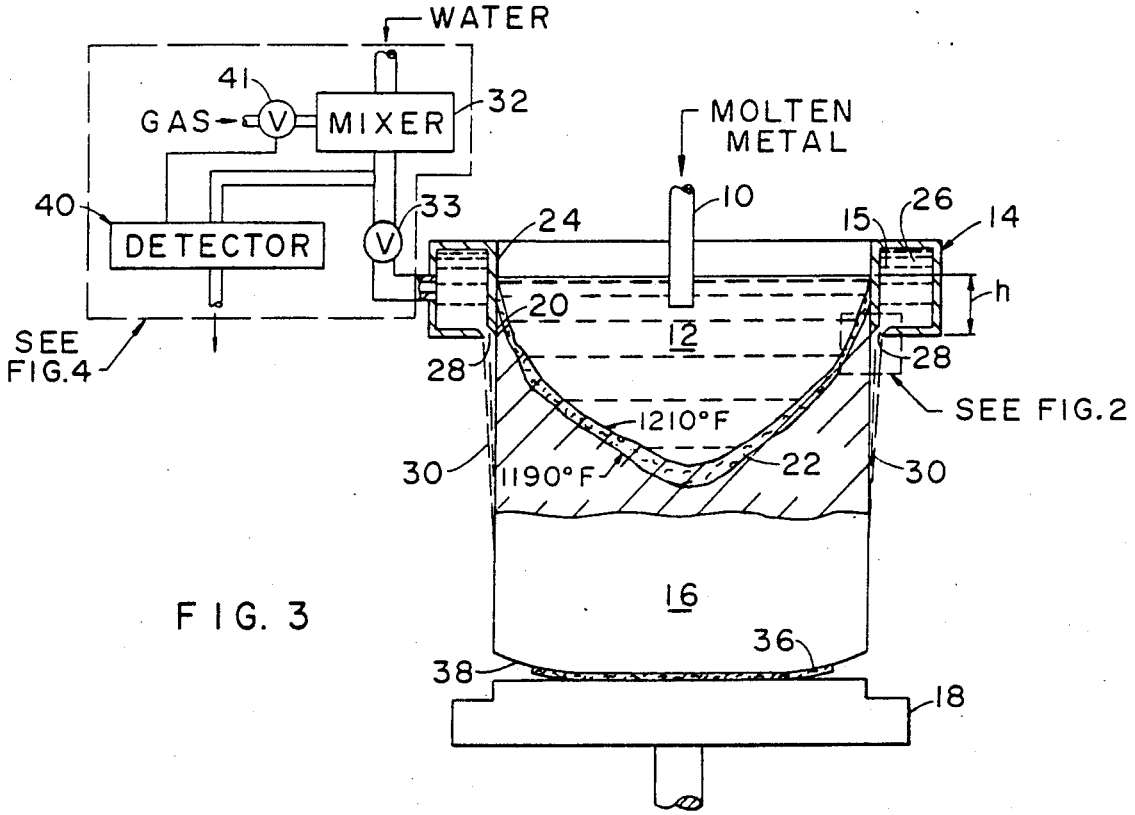
FIG. 3 is a view in vertical section showing the apparatus of the present invention.

Turning next to FIG. 3, there is illustrated an apparatus of the present invention. The apparatus of FIG. 3 is identical to that of FIG. 1 with the exception that a bubble detector 40 is positioned between valve 33 and mixer 32.

Figure 4:
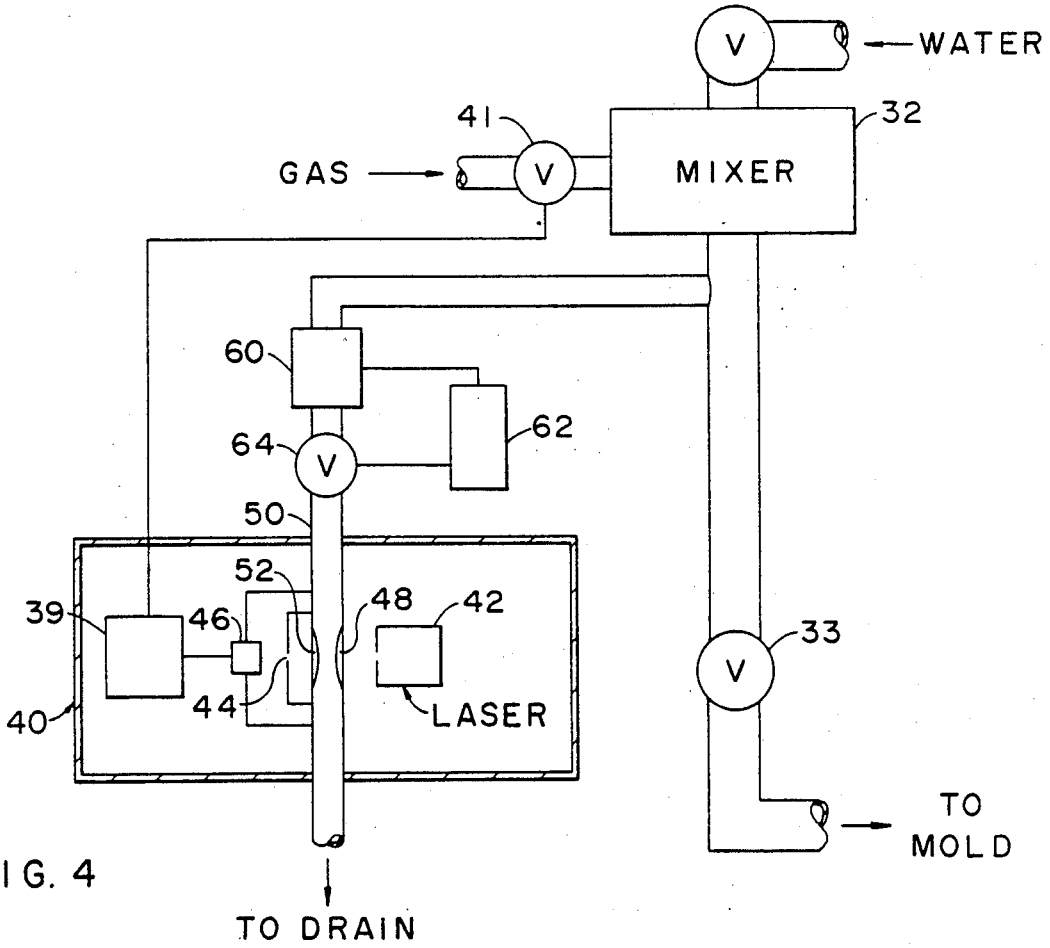
FIG. 4 is an enlarged cross-sectional view of portion IV of FIG. 3.

Turning next to FIG. 4, there is illustrated an enlarged cross-sectional view of portion IV of FIG. 3 which is unique to the present invention. As is more clearly seen in FIG. 4, flow meter 60, controller 62 and control valve 64 are positioned and adjusted to insure that the residence time of the water passing therebetween is substantially constant. As will be explained in more detail below, bubble detector 40 is not only designed to detect the presence of bubbles within coolant 15 but it is also designed to detect the presence of bubbles within a predetermined size range. Furthermore, bubble detector 40 will detect the relative density or the number density of these bubbles. The terms "number density" and "relative density" are used interchangeably herein and they both refer to the concentration of bubbles in a volume of liquid. As described in greater detail below, it is not necessary for bubble detector 40 to actually count the number of bubbles to determine the number density. The number density or relative bubble density of the fluid will be determined by comparing the output from bubble detector 40 to a reference. Both the output from detector 40 and the reference are representative of bubble density levels but neither actually needs to be an actual bubble count.

Thus, as will be discussed in greater detail below, bubble detector 40 discriminates between bubbles which are useful for a given application and other bubbles which are less useful. For example, in the method of U.S. Pat. No. 4,166,495, useful bubbles are those which contribute to insulation layer 34 (shown in FIG. 2) and bubbles which are excessively large gas bubbles which do not significantly contribute to insulation layer 34.

Bubble detector 40 comprises a light source 42, an aperture 44 and a sensor 46. The size and location of bubble detector 40 is such that it can continuously monitor the amount of small gas bubbles and evolving micron sized gas bubbles in the coolant prior to the coolant contacting the surface of ingot 16. Bubble detector 40 is connected to a microprocessor 39 which continuously calculates the optimum flow rate for the gas entering mixer 32. Microprocessor 39 performs this task by adjusting valve 41.

Light source 42 is positioned near a window 48 in conduit 50. Because of the scattering and low intensity of incandescent light, the preferred light source is laser light. Conduit 50 also contains a second window 52. Windows 48 and 52 are both transparent to the light emitting from light source 42. Windows 48 and 52 may be made of, for example, glass and are affixed to conduit 50 to prevent the loss of fluid.

Aperture 44 is positioned near sensor 46 and window 52, in such a manner that light emitted from light source 42 must pass through window 52 and aperture 44 before reaching sensor 46. Aperture 44 can be positioned adjacent to window 52 and outside conduit 50, as shown in FIG.4, or it can be positioned within conduit 50.

Sensor 46 is a photoconductive cell or photoelectric conversion element such as, for example, CdS or the like which is fixed to conduit 50. It is well known that the electric resistance value of the photoconductive cell will change in accordance with the intensity of light incident on the photoconductive cell. The photoconductive cell in sensor 46 is connected to microprocessor 39. The change in resistance in the photoconductive cell provides a continuous signal to microprocessor 39. The signal strength is related to the number density of the bubbles that are within a reference size range. Microprocessor 39 continuously compares the signal from sensor 46 to a reference signal or range of signals.

On the basis of this comparison, microprocessor 39 sends a command signal to a control (not shown) on valve 41 to either open or close the valve. The command will cause the valve to change by one increment. Since microprocessor 39 is continuously comparing the signal from sensor 46 to a reference signal, the opening in valve 41 will be changed by successive increments until the gas flow rate and thus the electrical input resistance from sensor 46 is within the reference range.

In operation, valve 64 is controlled by controller 62 to establish a standard residence time for the water passing between flow meter 60 and valve 64. If for example, water 15 is introduced into conduit 50 without any bubbles therein, light radiated from light source 42 through windows 48 and 52 and aperture 44, will hit sensor 46 and will cause microprocessor to register a base level electrical resistance input for a standard volume of water passing through the path of the light. When water 15 contains gas bubbles, light passing through conduit 50 will intercept a gas bubble as shown in either FIG. 5A or 5B.

In addition, if the water contains a gas under pressure, valve 64 will act to release the pressure in the system to a lower controlled pressure so that the bubble size and bubble density of the bubbles being detected is representative of the bubble size and bubble density of the water that is being applied to the surface of the emerging ingot. In this regard, the size and number density of the bubbles in conduit 50 need not be of the exact size and number as those being applied to the surface of the ingot. However, the bubble detector will need to be properly calibrated so that the microprocessor will be able to correctly determine if the generated input signal is too large or too small so that valve 41 can be adjusted accordingly.

Figure 5A:
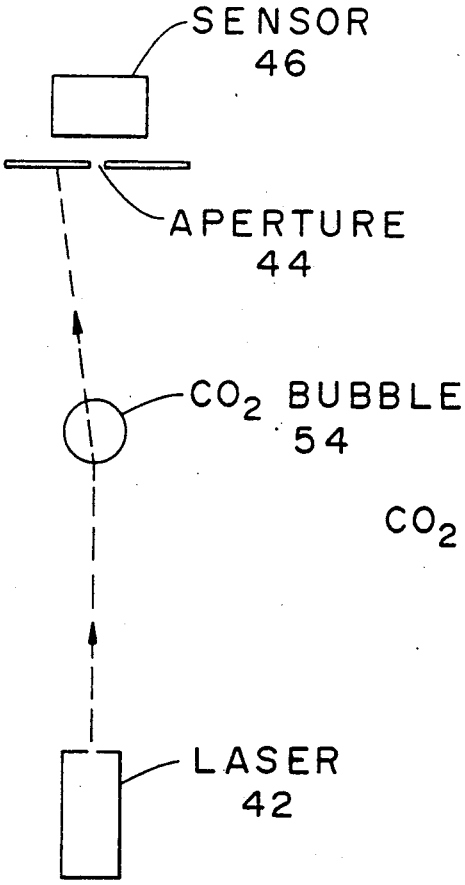
FIG. 5A is a diagrammatic depiction of the light scattering of a small bubble in the bubble detector system of the present invention.

If light passing through conduit 50 intercepts a gas bubble that is small in relation to the size of aperture 44, the light will take the path shown in FIG. 5A. Thus for example, in the method described in U.S. Pat. No. 4,166,495 when the light intercepts a bubble of the size that has been found to be desirable for forming insulating layer 34, the size of the aperture must be such that the light will not go through the aperture but will take the path shown in FIG. 5A.

The light scattered by bubble 54 decreases the intensity of the light incident on sensor 46 cell and its electrical resistance output to microprocessor 39. Microprocessor 39 continuously compares the signal from sensor 46 to a reference signal or range of signals. Based on this comparison, microprocessor 39 will then send a command signal to adjust valve 41 which controls the flow of gas.

It is to be noted that the signal from sensor 46 to microprocessor 39 is instantaneous. Therefore, microprocessor 39 can continuously monitor changes in the electrical resistance from the photoconductive cell due to the presence of small bubbles in the water. From this continuous monitoring, microprocessor 39 is continuously calculating whether the concentration of small bubble in the liquid coolant is in a range that has be determined to produce optimum heat transfer of the water stream as it is to be used for cooling the surface of ingot 16. Microprocessor 39 can instantaneously calculate the optimum flow rate for gas entering mixer 32 and open or close valve 41 to bring the electrical resistance input from sensor 46, and thus the small bubble concentration, to within a reference range. The reference operating range of electrical resistance for sensor 46 may be programed into microprocessor 39 with reference to the size of the ingot, the composition of the ingot which is being cast and the stage of casting, the position of the bottom block or the elapsed time in the casting operation.

Figure 5B:
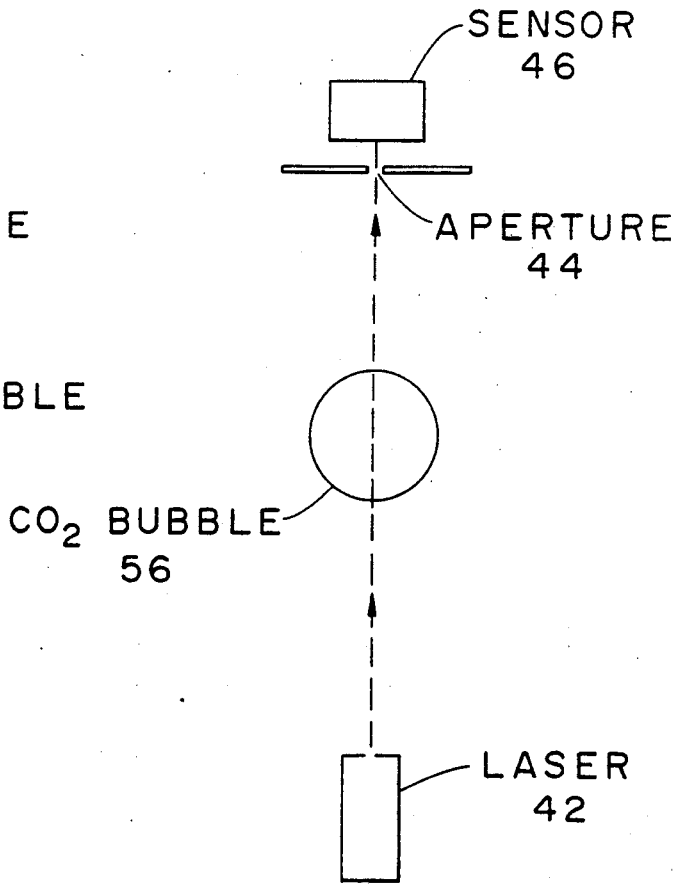
FIG. 5B is a diagrammatic depiction of the light scattering of a large bubble in the bubble detector system of the present invention.

If the light passing through conduit 50 intercepts an excessively large gas bubble 56, for instance of the size that may not contribute to the formation of insulating layer 34 (shown in FIG. 2), the light will take the path shown in FIG. 5B. The size of aperture 44 is selected such that light hitting an excessively large bubble 56 will not be deflected and will pass through the aperture. In the practice of the invention using $CO_2$ gas dissolved in water, bubble 56 can be considered to be excessively large if it is generally above the size of a millimeter. However, other gas-liquid systems may find a bubble size above a millimeter acceptable in which case, aperture 44 may be increased to accommodate such.

The size of aperture 44 acts to influence the sensitivity of the system to bubble size. The size of aperture 44 will determine if light hitting small bubble 54 will pass therethrough or be deflected or scattered. By varying the size of the aperture, one can vary the size of the bubbles that scatter light outside the aperture and decrease the intensity of the light incident on the photoconductive cell.

The ability of bubble detector 40 to discriminate between small bubbles 54 and excessively large bubbles 56 permits it to infer the volatility of the water stream and its heat transfer characteristics without the need to continually monitor the temperature of the water and/or water quality, gas flow rate and mixer effectiveness. The heat transfer characteristics of the liquid is related to the ability of the liquid to hold small bubbles. The ability of the liquid to hold small bubbles is dependent on the temperature of the water, the quality of the water and mixer effectiveness. By measuring the relative density of bubbles in a reference size range directly there is little or no need to continually monitor the temperature of the water and/or water quality, gas flow rate and mixer effectiveness to insure the liquid has the desired heat transfer characteristics.

Figure 6:
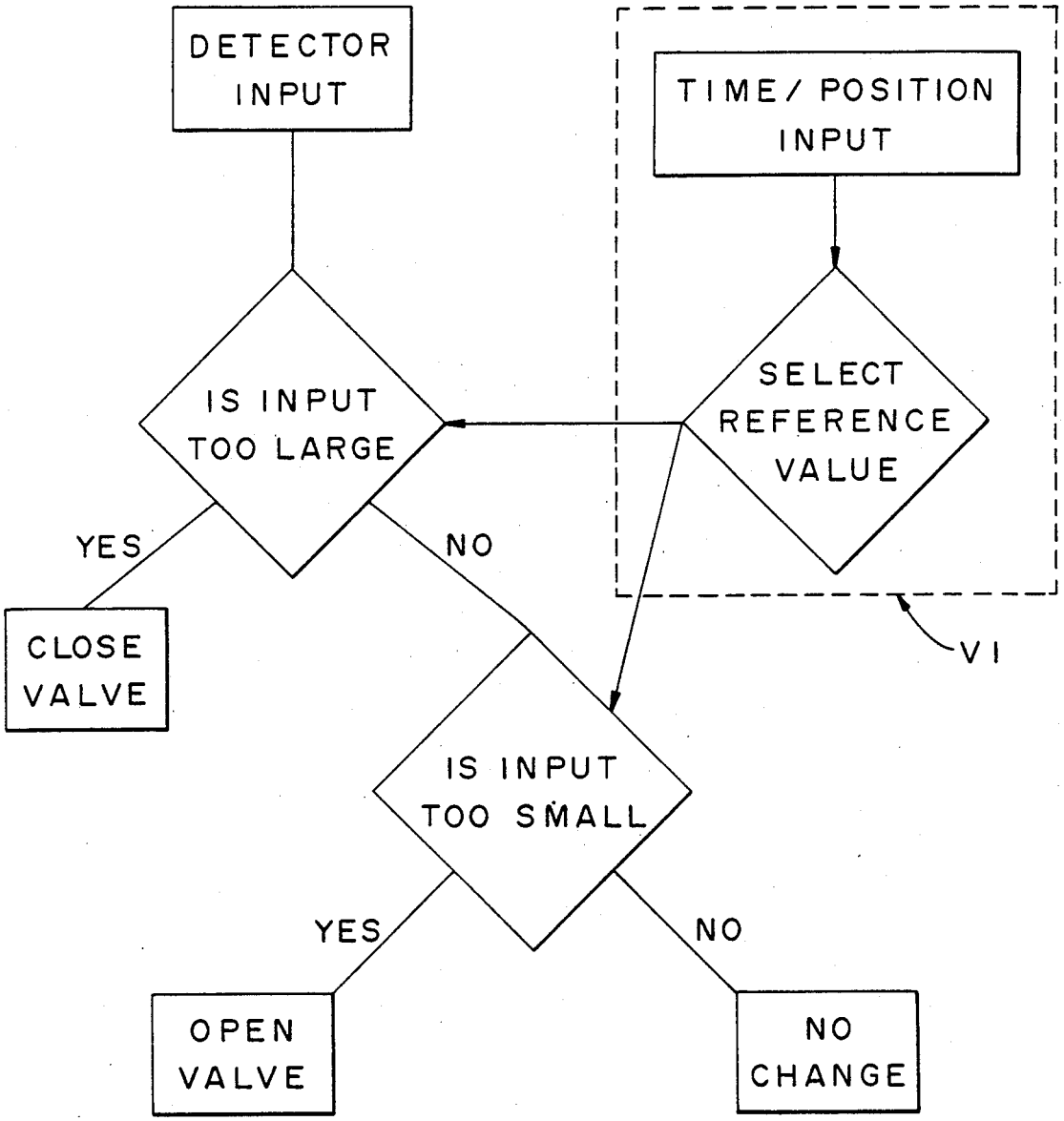
FIG. 6 is a logic and process flow diagram showing decisions of the process in controlling the flow of gas into the mixer.

FIG. 6 is a logic and process flow diagram showing decisions of the process in controlling the flow of gas into the mixer. Essentially the procedure followed in the process include the following steps:

(a) Inputting the sensor signal from the detector into the microprocessor.

(b) Determining if the input signal from the sensor is larger than a reference value stored in the microprocessor.

(c) If the input signal is larger than the reference signal stored in the microprocessor, sending a command signal to a control to close valve 41 by a predetermined amount so to downwardly adjust the flow rate of the gas.

(d) If the input signal is not larger than the reference signal stored in the microprocessor, determining if the input signal from the sensor is smaller than a reference value stored in the microprocessor.

(e) If the input signal is smaller than the reference signal stored in the microprocessor, sending a command signal to a control to open valve 41 by a predetermined amount so to upwardly adjust the flow rate of the gas.

(f) If the input signal is not smaller than the reference signal stored in the microprocessor, send no command to the control for valve 41.

Section VI of FIG. 6 shows an optional procedure that may be used in practicing the present invention. Those skilled in the art will recognize that it may be desirable for the reference value that is stored in microprocessor 39 not be constant. The initial casting rate of a continuously cast ingot is slower than the casting rate during the bulk of the casting process. Also, during the initial stages of the continuous casting operation, the butt end of the ingot lies adjacent a starting block rather than contiguous metal. The initial ingot cooling rate is therefore considerably higher than the cooling rate under steady state running conditions. Slow casting rates and rapid solidification at the start of a casting sequence combine to create a need for a fluid having a lower cooling capacity during the initial stages of solidification shrinkage in the butt end of the ingot. The predetermined reference value may be varied with time, withdrawal rate and/or the position of the bottom block to compensate for this need. Thus for example, during the start-up period a first value may be used that allows more $CO_2$ into the mixer than during the steady state condition. Microprocessor may be programmed to automatically change to a steady state reference value after a predetermined period of time into the cast or after the bottom block has reached a certain position. Alternately, the reference valve may vary gradually from a first value to a second value to reflect the gradual transition form the start-up phase to the steady state phase of casting. Naturally, the switch from a first start-up reference value to a second steady state reference value may also be controlled manually.

Section VI of FIG. 6 illustrates an optional procedure of the control system used in controlling the flow of gas into the mixer. Essentially the procedure of Section VI comprises the following steps:

(g) Inputting a time, withdrawal rate or bottom block signal or both withdrawal rate and bottom block signal into the microprocessor.

(h) Selecting a reference value stored in the microprocessor and using the selected value steps (b) and (d), described above, to determine if the input from the bubble detector is within the desired range.

Those skilled in the art will recognize that the actual reference value that one uses in practicing the present invention is system dependent. The actual value that one finds useful in practicing the present invention will vary according to a large numbers of variables. Some of these variables include the flow rates used, the heat lost in the system, the size of the ingot being cast, the composition of the ingot and the stage of casting.

It is contemplated that the apparatus of the present invention will be especially valuable in the casting of alloys having a short solidification range. As discussed above, alloys having short solidification are especially sensitive to ingot butt curl.

It is contemplated that the apparatus of the present invention will be valuable in the casting of alloys which are difficult to cast without cracking such as aluminum-lithium alloys and alloys containing zirconium. The present invention has been found useful in casting ingots of Aluminum Association Alloys in the 7XXX and 2XXX series alloys which have a large width to thickness ratio. However, the invention may be practiced on all alloys. Metals suitable for treatment with the present invention include aluminum, magnesium, copper, iron, nickel, cobalt, zinc, and alloys thereof.

It is also contemplated that the apparatus of the present invention will be valuable in operations other than the casting of alloys. In addition, the apparatus maybe used in an operation in which the liquid is not being used to cool, but rather is being used to heat an object. For this reason, the method and apparatus of the present invention are directed to controlling the heat exchange capacity of a liquid. It is believed that the method and apparatus of the present invention will have chemical and medical applications in that require sensitive temperature control. Thus for example in chemical reactions that are temperature dependent, the injection of gas bubbles into a hot liquid may be performed for the purpose of increasing the cooling capacity of the liquid and thus decreasing either the rate of reaction or the voliatility of the reaction.

It is also contemplated that the bubble detector of the present invention may use other than a laser as a source of light. Thus for example, those skilled in the art will recognize that incandescent light may be used in conjunction with convergent lens which focus a light source that otherwise would be too weak for use in the present invention. If a light source is used in the present invention, the light extinction (scattering) can be represented by the following:

$$1\text{-}e^{-KNL}$$

where K is constant; N is the bubble number density and L is the distance between windows 48 and 52.

It is also contemplated that means other than a light source may be used to detect bubbles and, if desired, infer the heat transfer characteristics of the liquid coolant which is used. Thus for example a sonic means can be used to detect bubbles. In addition, those skilled in the art will recognize that means other than non-intrusive means may be used in practicing the present invention. Thus for example, a system utilizing fiber optic probes which are placed into the flowing liquid coolant may also be used.

In addition, although the present invention has been described in terms of a bubble detector that discriminates between small bubbles that evolve from gas dissolved in a liquid and larger bubbles that may be less effective, it is not so limited. The aperture of the bubble detector can be reduced so that the presence of bubbles significantly larger than larger than micron sized bubbles can be detected. Thus, those skilled in the art will recognize that the present invention can be used to detect the number density of relatively large bubbles which are formed from gas that is entrained in a liquid coolant as a mass of bubbles that tend to remain discrete and undissolved.

Furthermore, whereas the apparatus and system of the present invention utilizes a microprocessor which send signals to a control which opens and closes valve 41 and thus change the flow of gas into the mixer, one skilled in the art will recognize that the microprocessor can be also connected to a device that opens and closes a valve which changes the flow of fluid into the mixer. Alternately, the microprocessor can be also connected to a devices that opens and closes valves which change the flow of gas and/or fluid into the mixer. In this embodiment of the present invention, the microprocessor will be programmed to calculate the optimum mixture of gas and fluid and determine whether the gas or fluid valve needs to be adjusted.

It is also contemplated that the improved monitoring capacity of the present invention can be utilized to automate a the casting of ingot having a rectangular cross-section which possesses a larger width to thickness ratios than has heretofore been commercially feasible. It would be highly desirable to be able to cast ingots without regard to their width to thickness ratio. This is because larger width to thickness ratios require fewer passes in the rolling mill and therefore less time, effort and money spent in rolling the ingots into sheets and plates.

The process disclosed in U.S. Pat. No. 4,166,495 has been successfully used to cast ingot having a width to thickness ratio of 5.3 which is a large aspect ratio for a large ingot. It is believed that improving the control of the of the amount of gas that is mixed into the liquid coolant will minimize fluctuations in the heat transfer capacity of the gas containing liquid due to changes in temperature, mixing pressure, and water quality and thus allow those skilled in the art to cast large ingot at higher width to thickness ratios than have been commercially feasible without a decrease in safety. Those skilled in the art will appreciate that casting large ingot with larger width to thickness ratios will reduce downstream fabrication cost.

Those skilled in the art will recognize that ingot casting molds can be designed for receiving liquid coolant from more than one source with each source of liquid coolant connected to a bubble detector that has been separately programmed. The flow from several separately programmed bubble detectors can then been combined to create a variation in the concentration of the small bubbles in the of water on the emerging ingot. The variation in the concentration of the small bubbles across surface of a rectangular ingot can be designed to compensate for the variation in the cooling characteristics of the rectangular ingot. In this manner, the center of the width of the ingot can be cooled at a rate that is different than the edge. One skilled in the art will recognize that the computer controlled variation in the number density of the small bubbles forming the insulation layer in the blanket of water on the emerging ingot will also contribute to the casting of ingots which possess a larger width to thickness ratios than has heretofore been commercially possible.

It is also believed that the use of a plurality of separately programmed bubble detectors that are combined to create a variation in the concentration of the small bubbles dissolved in the blanket of water on the emerging ingot will allow those skilled in the art to cast ingots with a rectangular cross section. The variation in the concentration of the small bubbles dissolved in the blanket of water on the emerging ingot can be used to compensate for the cooling differential in the ingot which has its lowest cooling near the middle of its longer sidewalls and its greatest cooling at the corners and along the shorter sidewalls of the ingot. Thus, the variation in the concentration of the small bubbles in the water blanket can be used to retard the cooling in the corners and along the shorter sidewalls of a rectangular ingots and thus reduce the variation in the ingots surface cooling and thus allow those skilled in the art to cast at higher width to thickness ratios than have been commercially feasible without a decrease in safety.

Although the invention has been described in terms of a preferred embodiment in which carbon dioxide gas is dissolved in water, the gases comprehended by the present invention include any gas or chemical that is more volatile than the liquid cooling medium or chemical that releases gases when it comes into contact with a hot surface. Gases that may be used when water is used as the coolant include but are not limited to, carbon dioxide, air, oxygen, nitrogen, furnace gas and mixtures thereof. In a second preferred embodiment of the present invention, the preferred gas is air which is entrained in water as a mass of bubbles that tend to remain discrete and undissolved as the water is directed at the surface of an emerging ingot.

Furthermore, although the invention of the present invention has been described in terms of a gas that is mixed in a flowing liquid, the invention is also intended to include a liquid coolant being mixed into a flowing gas. Those skilled in the art will recognize that the bubble detector will then be used to detect droplets of liquid coolant suspended in the gas.

Whereas the preferred embodiments of the present invention have been described above in terms of a continuous vertical casting system for purposes of illustration, it will be apparent to those skilled in the art that numerous variations of the details of the casting system, in which the present invention is to be used, may be made without departing from the invention. For example, casting may be done in other known casting methods, such as DC casting or EM casting. In addition, the casting may be accomplished in other than vertical casting systems. Thus for example the casting may be performed in the horizontal direction, as described in U.S. Pat. No. 4,474,225, issued to Ho Yu Oct. 2, 1984. In addition, the casting need not be continuous but may be intermittent.

Since changes may be made in the process and apparatus described above without departing from the scope of the invention, it is intended that all matter contained in the above description or shown in the accompanying drawings shall be interpreted as illustrative. The present invention is indicated by the broad general meaning of the terms in which the following claims are attached.

What is claimed is:

1. A method for continuously controlling the heat exchange capacity of a liquid containing gas bubbles, said method comprising the steps of:

detecting the relative density of said bubbles;

comparing said relative density to a reference density range; and varying the amount of gas in said liquid so that said relative density is within said reference range.

2. The method of claim 1 in which said step of detecting the relative density of said bubbles within a size range, includes:

using a light source and light sensor to detect the amount of light scattered by said bubbles.

3. The method of claim 2 in which said step of using a light source and light sensor, includes:

using a laser as said light source.

4. The method of claim 1 in which said step of detecting the relative density of said bubbles within a size range, includes:

using a sonic means to detect the relative density of said bubbles.

5. The method of claim 1 in which said step of detecting the relative density of said bubbles within a size range, includes:

providing laser light;

providing a light sensing device positioned to detect said laser light that has passed through said liquid containing gas bubbles; and focusing said laser light on said light sensing device to sense the number density of said bubbles from the scattering of said light from said laser.

6. The method of claim 5 in which said step of providing a light sensing device includes:

positioning said sensing device so that it will detect light from said laser that has passed through (a) said liquid containing gas bubbles and (b) an aperture.

7. The method of claim 1 in which said step of varying the amount of gas in said liquid coolant so that said number density is within said predetermined range, includes:

reducing the relative amount of said gas that is being mixed with said liquid if said relative density of said bubbles exceeds a first value; or increasing the relative amount of said gas that is being mixed with said liquid if said relative density of said gas bubbles falls below a second value.

8. The method of claim 7 in which said step of reducing the relative amount of said gas in said liquid, includes:

reducing the flow of said gas that is being mixed with said liquid without varying the flow of said liquid.

9. The method of claim 7 in which said step of increasing the relative amount of said gas in said liquid, includes:

increasing the flow of said gas without varying the flow of said liquid.

10. The method of claim 1 in which said step of varying the amount of gas in said liquid coolant, includes:

reducing the relative amount of said gas in said liquid by increasing the flow of liquid if the number density of said bubbles exceeds a first value; and increasing the amount of said gas in said liquid by decreasing the flow of said liquid coolant if the density of said gas bubbles falls below a second value.

11. A method for continuously monitoring and controlling the heat exchange capacity of a liquid containing gas bubbles mixed therein, said method comprising the steps of:

generating a signal which is related to the number density of said bubbles; and comparing said generated signal to a reference signal.

12. The method of claim 11 which further includes the step of:

varying the relative amount of gas that is being mixed with said liquid to bring said generated signal closer to said reference signal when said generated signal is outside said reference range.

13. The method of claim 12 in which said step of varying the amount of gas that is being mixed with said liquid so that said generated signal is within said predetermined signal range, includes:

reducing the relative amount of said gas that is being mixed with said liquid if said generated signal exceeds a first reference signal; or increasing the relative amount of said gas that is being mixed with said liquid if said generated signal falls below a second reference signal.

14. The method of claim 11 in which said step of generating a signal which is related to the relative density of said bubbles, includes:

using a light source and light sensor to generate a signal that is related to the amount of light scattered by said bubbles.

15. The method of claim 14 in which said step of using a light source and light sensor, includes:

using a laser as said light source.

16. The method of claim 11 in which said step of generating a signal which is related to the relative density of said bubbles, includes:

using a sonic means to generate said signal.

17. The method of claim 11 in which said step of generating a signal which is related to the relative density of said bubbles, includes:

providing laser light;

providing a light sensing device positioned to detect said laser light that has passed through said liquid;

focusing said laser light on said light sensing device to detect the relative density of said bubbles from the scattering of said light; and generating a signal which is related to said scattering.

18. The method of claim 17 in which said step of providing a light sensing device includes:

positioning said sensing device to detect light from said laser that has passed through (a) said liquid containing gas bubbles and (b) an aperture.

19. A method for continuously casting metal ingots using a liquid coolant, said method comprising the steps of:

casting molten metal into an open-ended mold used to form an ingot emerging therefrom;

providing a liquid coolant;

mixing a gas with said liquid so that said liquid contains gas bubbles;

detecting the relative density of said bubbles;

comparing said relative density to a reference range;

when said relative density is outside said reference range, varying the relative amount of gas that is being mixed with said liquid to bring said relative density within said reference range; and applying said liquid to said ingot emerging from said mold to effect at least partial solidification of said molten metal.

20. The method of claim 19 in which said step of casting molten metal into an open-ended mold includes said melt being an alloy selected from the group consisting of aluminum, copper, zinc, steel, nickel, cobalt, titanium, magnesium and alloys thereof.

21. The method of claim 19 in which said step of providing a liquid, includes:

providing water.

22. The method of claim 19 in which said step of mixing a gas with said liquid so that said liquid contains gas bubbles, includes:

mixing said gas at pressures greater than atmospheric pressure a gas selected from the group consisting of nitrogen, oxygen, carbon dioxide, air and mixtures thereof into said liquid.

23. The method of claim 22 in which said step of mixing said gas at pressures greater than atmospheric includes:

dissolving said gas under pressure prior to its application to the ingot and whereupon said dissolved gas comes out of solution in response to a decrease in pressure as said liquid coolant is directed at said ingot.

24. The method of claim 22 in which said step of mixing said gas at pressures greater than atmospheric includes:

mixing said gas under pressure prior to its application to the ingot and whereupon said gas is entrained in said liquid coolant as a mass of bubbles that tend to remain discrete and undissolved in said liquid as said liquid is directed at said ingot.

25. The method of claim 19 in which said step of detecting the relative density of said bubbles within a size range, includes:

using a light source and light sensor to detect the amount of light scattered by said bubbles.

26. The method of claim 25 in which said step of using a light source and light sensor, includes:
using a laser as said light source.

27. The method of claim 19 in which said step of detecting the relative density of said bubbles within a size range, includes:
using a sonic means to detect the relative density of said bubbles.

28. The method of claim 19 in which said step of detecting the relative density of said bubbles within a size range, includes:
providing laser light;
providing a light sensing device positioned to detect said laser light that has passed through said liquid containing gas bubbles;
focusing said laser light on said light sensing device to detect the relative density of said bubbles from the scattering of said light.

29. The method of claim 28 in which said step of providing a light sensing device includes:
positioning said sensing device to detect said laser light that has passed through (a) said liquid containing gas bubbles and (b) an aperture.

30. The method of claim 19 in which said step of varying the relative amount of gas that is being mixed with said liquid to bring said generated signal is within said reference range, includes:
reducing the relative amount of said gas that is being mixed with said liquid if said relative density of said bubbles exceeds a first value; or
increasing the relative amount of said gas that is being mixed with said liquid if said relative density of said gas bubbles falls below a second value.

31. The method of claim 30 in which said step of reducing the relative amount of said gas that is being mixed with said liquid, includes:
reducing the flow of said gas that is being mixed with said liquid without varying the flow of said liquid.

32. The method of claim 30 in which said step of increasing the relative amount of said gas that is being mixed with said liquid, includes:
increasing the flow of said gas without varying the flow of said liquid.

33. A method for continuously casting metal ingots using a liquid coolant, said method comprising the steps of:
casting molten metal into an open-ended mold to form an ingot which emerges therefrom;
providing a liquid for cooling said ingot;
mixing a gas with said liquid coolant so that said liquid contains gas bubbles;
passing light through said liquid onto a light sensing device;
detecting the relative density of bubbles that fall within a reference range from the scattering of said light and generating a signal therefrom;
comparing said number density to a reference signal;
when said generated signal is outside said reference range, varying the relative amount of gas that is being mixed with said liquid coolant to bring said generated signal within said reference range; and
varying said reference range from a first range that is used during the first stages of casting to a second range that is used when said emerging ingot is in a second stage; and
applying said liquid to said ingot emerging from said mold to effect at least partial solidification of the molten metal.

34. The method of claim 33 in which said step of varying the relative amount of gas that is being mixed with said liquid to bring said generated signal is within said reference range, includes:
reducing the relative amount of said gas that is being mixed with said liquid if said relative density of said bubbles exceeds a first value; or
increasing the relative amount of said gas that is being mixed with said liquid if said relative density of said gas bubbles falls below a second value.

35. A method for continuously casting metal ingots using a liquid coolant, said method comprising the steps of:
casting molten metal into an open-ended mold used to form an ingot which emerges therefrom;
providing a liquid coolant;
mixing a gas with said liquid so that said liquid coolant contains gas bubbles;
generating a signal which is related to the relative density of said bubbles; and
passing light through said liquid coolant onto a light sensing device to determine the relative density of said liquid coolant;
comparing said generated signal to a reference signal;
when said generated signal is outside said reference range, varying the relative amount of gas that is being mixed with said liquid coolant to bring said generated signal is within said reference range;
varying said reference range from a first range that is used during the initial stages of casting when said ingot is in a startup state to a second range that is used when said emerging ingot is in a steady state; and
applying said liquid to said ingot emerging from said mold to effect at least partial solidification of the molten metal.

36. An improved method for cooling the surface of metal, said method comprising the steps of:
mixing gas into a liquid coolant to form an improved liquid coolant and applying said coolant to said metal, said gas forming bubbles which act to retard the rate of heat extraction from said metal;
continually detecting the relative density of said bubbles within a reference range;
comparing said number density to a reference range;
when said generated signal is outside said reference range, varying the relative amount of gas that is being mixed with said liquid to bring said number density within said reference range.

37. The method of claim 36 in which said step of mixing a gas to form an improved liquid coolant, includes:
mixing said gas at pressures greater than atmospheric pressure a gas selected from the group consisting of nitrogen, carbon dioxide and air into said liquid coolant.

38. The method of claim 36 in which said step of mixing said gas at pressures greater than atmospheric includes:
dissolving said gas under pressure prior to its application to the ingot and whereupon said dissolved gas comes out of solution in response to a decrease in pressure as said liquid coolant is directed at said ingot.

39. The method of claim 36 in which said step of mixing said gas at pressures greater than atmospheric includes:

mixing said gas under pressure prior to its application to the ingot and whereupon said gas is entrained in said liquid coolant as a mass of bubbles that tend to remain discrete and undissolved in said liquid coolant as said liquid coolant is directed at said ingot.

40. The method of claim 36 in which said step of continually detecting the number density of said bubbles within a size range, includes:

using a light source and light sensor to detect the amount of light scattered by said bubbles.

41. The method of claim 36 in which said step of varying the relative amount of gas that is being mixed with said liquid coolant so that said number density is within said reference range, includes:

reducing the amount of said gas that is being mixed with said liquid if said relative density of said bubbles exceeds a first value; or increasing the relative amount of said gas that is being mixed with said liquid if said number density of said gas bubbles falls below a second value.

42. An improved method for the continuous casting of molten metal into an ingot in which a liquid coolant is applied to an open-ended mold to effectuate at least partial solidification of the molten metal therein, said liquid coolant containing gas that forms bubbles which act to retard the rate of heat extraction from said ingot, the improvement comprising the steps of:

detecting the relative density of said bubbles within a size range; and comparing said relative density to a reference density number; and varying the amount of gas that is being mixed with said liquid so that said relative density is within said reference range.

43. An apparatus for continuously monitoring and controlling the heat exchange capacity of a liquid containing gas bubbles, said apparatus comprising:

a detecting means for detecting the relative density of said bubbles; and a varying means for varying the amount of gas dissolved within said liquid coolant if said number density is outside a reference range.

44. The apparatus of claim 43 in which said sensing means includes:

a light source; a screening device having at least one aperture; and a sensor positioned to detect light emitted from said light source that has passed through said aperture.

45. The apparatus of claim 44 in which said detecting means includes:

a lens for focusing light from said light source onto said sensor.

46. The apparatus of claim 44 in which said light source is a laser.

47. The apparatus of claim 43 which further includes:

a mixing chamber for mixing said gas and said liquid coolant.

48. The apparatus of claim 47 in which said varying means controls a valve which varies the flow of said gas into said mixing chamber.

49. The apparatus of claim 47 in which said varying means controls a valve which varies the flow of said liquid medium into said mixing chamber.

50. An apparatus for casting a melt into an ingot, said apparatus comprising:

an open-ended mold for casting a continuously or semicontinuously cast ingot;

an application means for applying liquid to said ingot to effect at least partial solidification thereof, said liquid containing a gas bubbles which retard the rate of heat extraction from said ingot;

a detecting means for detecting the density of said bubbles to infer the heat transfer characteristics of said liquid coolant;

a varying means for varying the amount of gas dissolved within said liquid coolant if said inferred heat transfer characteristic is outside a reference range; and a means for applying said liquid coolant to said ingot emerging from said mold to effect at least partial solidification of the molten metal.

51. The apparatus of claim 50 in which said measuring means includes:

a light source;

a screening device containing at least one aperture; and a sensor positioned to detect light emitted from said light source that has passed through said aperture.

52. The apparatus of claim 51 in which said detecting means includes:

a lens for focusing light from said light source onto said sensor.

53. The apparatus of claim 51 in which said light source is a laser.

54. The apparatus of claim 50 in which said varying means includes:

a means for reducing the amount of said gas that is being mixed with said liquid if said inferred heat transfer characteric exceeds a first value and increasing the amount of said gas that is being mixed with said liquid if said inferred heat tranfer characteric falls below a second value.

55. The apparatus of claim 50 which further includes:

a mixing chamber for mixing said gas and said liquid coolant.

56. The apparatus of claim 55 in which said varying means controls a valve which varies the flow of said gas into said mixing chamber.

57. The apparatus of claim 55 in which said varying means controls a valve which varies the flow of said liquid medium into said mixing chamber.

58. An apparatus for casting a melt into a rectangular ingot possessing a high width to thickness ratio, said apparatus comprising:

an open-ended mold for casting a continuously or semicontinuously cast ingot, said mold possessing a high width to thickness ratio, said mold holding a reservoir of melt;

an application means for applying liquid to said mold to effect at least partial solidification of the molten metal therein, said liquid containing a gas bubbles mixed therein;

a detecting means for detecting the relative density of said bubbles within a size range; and a comparing means for comparing said relative density to a reference range;

when said relative density is outside said reference range, varying the relative amount of gas that is being mixed with said liquid to bring said relative density within said reference range.

59. An apparatus for casting a melt into an ingot, said apparatus comprising:

an open-ended mold for casting molten metal into a continuously or semicontinuously cast ingot;

a plurality of mixing chambers for mixing pressurized gas into a liquid to form an improved liquid, each of said plurality of mixing chambers being independently operable and capable of mixing a different amount of said gas into said liquid;

a plurality of application means for applying said improved liquid to said mold to effect at least partial solidification of the molten metal therein, said improved liquid containing gas bubbles which form an insulation layer on the surface of said ingot and act to retard the rate of heat extraction from said ingot, each of said plurality of application means being independently operable and capable of applying said improved liquid to said mold to create zones containing different insulation layers;

a plurality of detecting means positioned for detecting the relative density of said bubbles flowing into a different application means;

a plurality of comparing means, each of said plurality of control means capable of comparing said relative density to a different reference density range;

a plurality of varying means for varying the amount of gas that is being mixed with said liquid to bring each said relative density within its said reference range; and a means for applying said liquid coolant to said ingot emerging from said mold to effect at least partial solidification of the molten metal.

60. The apparatus of claim 59 in which each of said plurality of varying means controls a valve which varies the flow of said gas into each of said plurality of mixing chambers.

61. A method for continuously monitoring and controlling the heat exchange capacity of a liquid-gas mixture, said method comprising the steps of:

mixing gas with a liquid to form a liquid-gas mixture;

detecting the relative density of gas bubbles in said liquid-gas mixture that are within a reference range; and comparing said relative density to a reference density range; and varying the amount of gas that is being mixed with said liquid so that said relative density is within said reference range.

62. An apparatus for comparing the heat exchange capacity of a liquid containing gas bubbles, said apparatus comprising:

a generating means for generating a signal related to the relative density of said bubbles;

a comparing means for comparing said generated signal to a reference signal; and a varying means for varying the amount of gas in said liquid

63. A method for continuously controlling the heat exchange capacity of a gas containing droplets of liquid, said method comprising the steps of:

detecting the relative density of said droplets;

comparing said relative density to a reference density range; and varying the amount of gas in said liquid so that said relative density is within said reference range.

64. The method of claim 63 in which said step of detecting the relative density of said droplets within a size range, includes:

using a light source and light sensor to detect the amount of light scattered by said droplets.

65. The method of claim 64 in which said step of using a light source and light sensor, includes:

using a laser as said light source.

66. The method of claim 63 in which said step of detecting the relative density of said droplets within a size range, includes:

using a sonic means to detect the relative density of said droplets.

67. A method for continuously monitoring the heat exchange capacity of a gas containing droplets of liquid mixed therein, said method comprising the steps of:

generating a signal which is related to the number density of said droplets; and comparing said generated signal to a reference signal.

68. The method of claim 67 in which said step of generating a signal which is related to the relative density of said droplets, includes:

using a light source and light sensor to generate a signal that is related to the amount of light scattered by said droplets.

69. The method of claim 68 in which said step of using a light source and light sensor, includes:

using a laser as said light source.

70. The method of claim 67 in which said step of generating a signal which is related to the relative density of said droplets, includes:

using a sonic means to generate said signal.

71. A method for continuously monitoring and controlling the heat exchange capacity of a gas containing droplets of liquid mixed therein, said method comprising the steps of:

generating a signal which is related to the number density of said droplets;

comparing said generated signal to a reference signal; and varying the relative amount of gas that is being mixed with said liquid to bring said generated signal closer to said reference signal when said generated signal is outside said reference range.

* * * * *